US005121571A

United States Patent [19]

Smarsh

[11] Patent Number: 5,121,571

[45] Date of Patent: Jun. 16, 1992

[54] WORKPIECE SUPPORT FOR CENTERLESS GRINDER

[76] Inventor: Steven G. Smarsh, 2440 Parmenter, Royal Oak, Mich. 48073

[21] Appl. No.: 662,982

[22] Filed: Feb. 28, 1991

Related U.S. Application Data

[63] Continuation of Ser. No. 475,239, Feb. 5, 1990, abandoned.

[51] Int. Cl.[5] ..... B24B 5/307

[52] U.S. Cl. ..... 51/103 R; 51/238 GG; 51/241 R

[58] Field of Search ..... 51/103 R, 129, 241 R, 51/238 R, 238 S, 238 GG, 240 A, 240 R, 240 T, 105 R, 103 TF

[56] References Cited

U.S. PATENT DOCUMENTS

| | | | |
|---|---|---|---|
| 2,417,413 | 3/1947 | Hopkins | 51/238 GG |
| 2,474,138 | 6/1949 | Zimmerman | 51/238 GG |
| 2,889,666 | 6/1959 | Coes, Jr. | 51/129 |
| 2,897,636 | 8/1959 | Pyne et al. | 51/238 GG |
| 3,640,026 | 2/1972 | Flanigan | 51/215 R |
| 3,729,300 | 4/1973 | MacKay et el. | 51/241 R |
| 3,874,128 | 4/1975 | Ishii | 51/236 |
| 3,899,943 | 4/1975 | Schaller | 82/130 |
| 4,055,027 | 10/1977 | Freddi | 51/238 GG |
| 4,292,766 | 10/1981 | Kirk et al. | 51/238 GG |
| 4,634,323 | 1/1987 | Wagner et al. | 51/238 S |

*Primary Examiner*—Bruce M. Kisliuk
*Assistant Examiner*—John A. Marlott
*Attorney, Agent, or Firm*—Weintraub, DuRoss & Brady

[57] ABSTRACT

A workpiece support apparatus for centerless grinding includes a rotatable base mountable to a standard grinding machine and a carriage assembly mounted on the rotatable base. The carriage assembly has a motor driven regulating roller attached thereto for driving the workpiece. A work blade holder attached to the carriage is pivotable in both the horizontal and vertical directions and has means for attaching a work blade thereto. The work blade holder is located on one side of the regulating roller and has its axis generally parallel thereto. Pivotally attached to the carriage on the side of the regulating roller opposite from the work blade holder is a workpiece guide holder adjustably biased towards the regulating roller. Workpiece guides selectively attachable thereto include a pressure roller and a guide rest plate with a workpiece guide blade magnetically mounted thereon.

22 Claims, 3 Drawing Sheets

X
Y
14
15
58
80
94
10
38
16
43
74
21
56
94
44
46
57
45
40
22
98
30
90
54
32
72
52
75
26
31
27
91
70
20
24
18
78
48
50
105
76
19
12
51
13
103
11
17
100
102
28
104

FIG 2
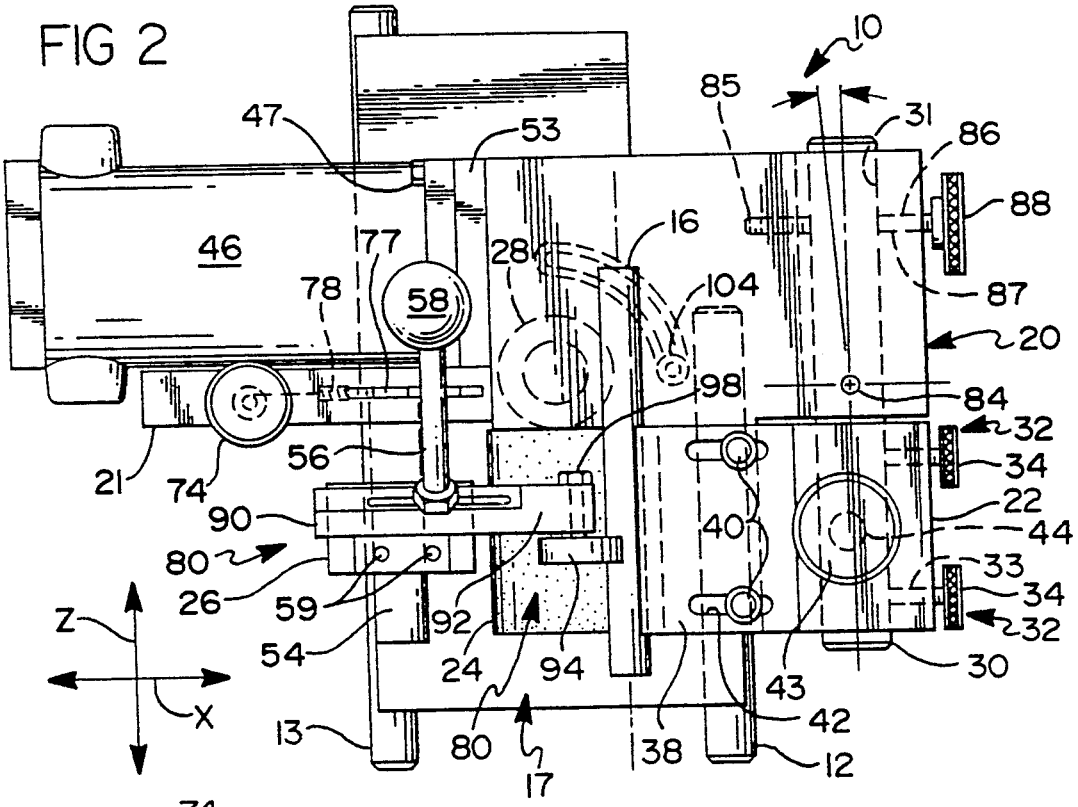
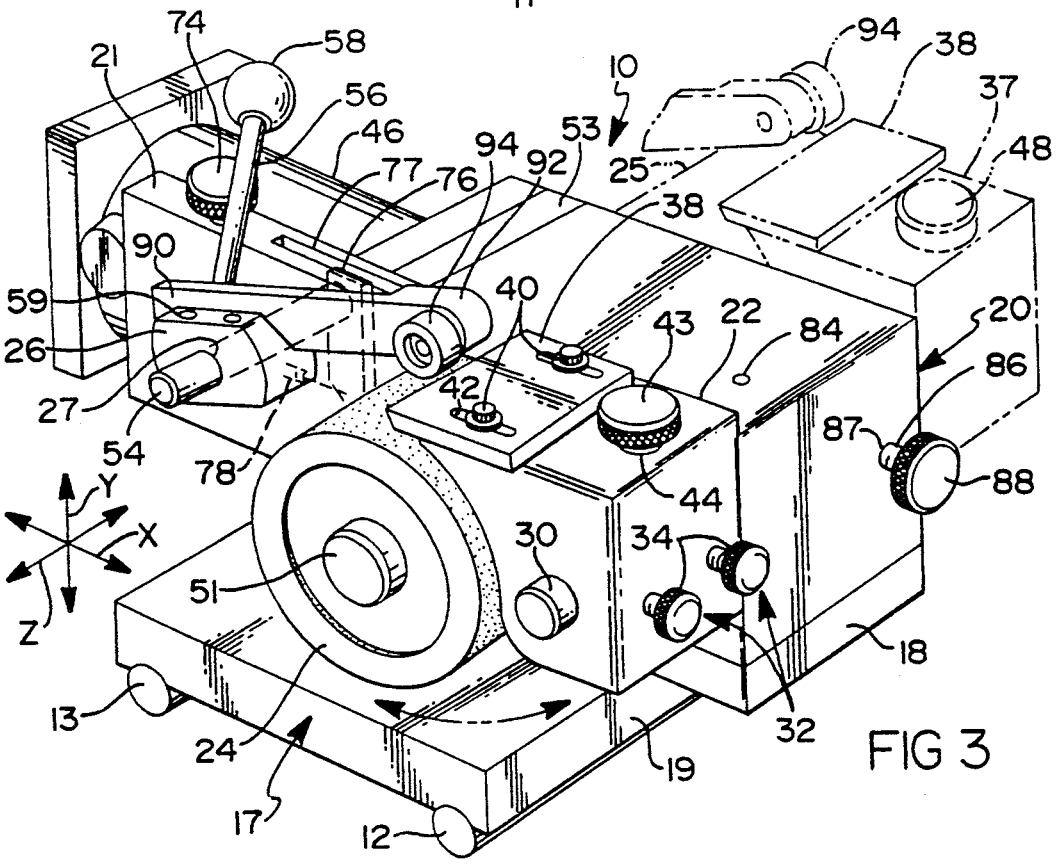
FIG 3

WORKPIECE SUPPORT FOR CENTERLESS GRINDER

BACKGROUND OF THE INVENTION

This application is a continuation of Ser. No. 07/475,239, filed Feb. 5, 1990, now abandoned.

The present invention was the subject of a Disclosure Document No. 235,696 filed Sep. 18, 1989 in the U.S. Patent and Trademark Office.

Field of the Invention

This invention relates generally to a centerless grinding apparatus. More particularly, the invention relates to a centerless grinder workpiece support apparatus with pivotable workpiece guide and work blade holders.

DESCRIPTION OF THE RELATED ART

Centerless grinding is a well known art and many machines have been developed for this purpose. Standard operational elements for a centerless grinding operation include a work blade against which the workpiece is moved during grinding; a guide rest upon which the workpiece enters and leaves the grinding operation; and, a guide blade which serves as a backstop to the workpiece during grinding operations. Indicative of such machines is U.S. Pat. No. 3,729,300 to Mackay et al, which discloses a fixture for converting a surface grinder to a centerless grinder. Means for adjusting the horizontal blade and other elements operating on the workpiece are disclosed. However, with each new and/or different sized workpiece to be inserted into the grinder, the operational elements, i.e., those operating on the workpiece, must be laboriously and accurately readjusted to obtain consistent grinding results on the workpieces.

Adjustment of such a workpiece support apparatus during grinding of the workpiece, and in particular, adjustment of the work blade against which the workpiece is rotated during grinding, is made very difficult in the known apparatuses due to lack of provision of readily adjustable operational elements.

Trueing of the standard operational elements for consistent grinding results is also known to consume much work time when using the known devices, such as in Mackay et al, where the regulating roller is removed from its spindle for trueing of the roller and the work blade is unbolted and removed for trueing. Where close tolerances are to be maintained on the ground workpiece, trueing of the operational work elements may take place after each workpiece grinding and may soon expend the majority of the operator's time in set-up, take-down, and separate trueing of the operational elements.

It is therefore desirable to provide pivotable holders for the guide blade and work blade operational elements as is done in the present invention. These pivotable elements need to be accurately set for grinding of the workpiece only once on their holders. When removal of the workpiece or moving of the operational elements becomes necessary, the holders are pivoted to the non-operative position leaving the operational elements still properly adjusted on their holders. The workpiece can then be removed, and a new piece of the same or different size inserted without readjustment of the operational elements. Also, the operational elements can be trued without removal or readjustment of the operational elements from the support apparatus. The holders can then be pivoted to the operational position with the operational elements thereon still in proper adjustment.

Utilization of a pivotally mounted work blade allows the work blade to adjust to different diameter workpieces merely by pivoting the work blade holder through a constant arc.

SUMMARY

In accordance with the present invention, there is provided a workpiece support apparatus for centerless grinding, comprising:

(a) a base plate mountable on a grinding apparatus;

(b) a carriage assembly mountable on the base plate;

(c) a work blade holder attached to the carriage including:

(1) means for pivoting the work blade holder between workpiece engaging and non-engaging positions, and (2) means for angling the work blade holder with respect to the axis of a regulating roller;

(d) a regulating roller attached to the carriage for rotating the workpiece, and means for rotating the regulating roller; and, (e) a workpiece guide holder attached to the carriage including:

(1) means for pivoting a workpiece guide element between workpiece engaging and non-engaging positions, and (2) means for securing at least one workpiece guide element thereto.

The base plate will ordinarily be rotatably mounted on the grinding apparatus to enable a change in grinding direction on the workpiece. The grinding apparatus is usually laterally adjustable in both x and z axes; with the x axis being horizontally transverse to the axis of the regulating roller and the z axis being parallel to the axis of the regulating roller. The grinding apparatus includes a grinding wheel adjustable vertically, i.e., in the y axis. The carriage will ordinarily be tiltable from the horizontal.

The carriage is mounted on the base plate and therefore travels with it. The carriage provides a frame for the mounting of the operational elements. The work blade holder carries the work blade, which is the operational element responsible for providing a steady rest for the workpiece during grinding operations. The work blade holder is pivotable in the y axis to allow for adjustment of the work blade to varying sized workpieces, and is also horizontally pivotable between the x and z axes to allow for adjustment of the feed rate of the workpiece during feed-through grinding operations.

The regulating roller is attached to a spindle located generally within the carriage. The regulating roller sits aside the work blade holder and rotates the workpiece during usual grinding operations. The regulating roller is driven through the spindle by a motor and gear train attached to the carriage.

The workpiece guide holder carries a workpiece guide element such as a guide blade and an associated guide rest plate, or a pressure roller, as the operational element responsible for containing the workpiece on that side opposite the work blade. Besides being pivotable, the guide holder is also adjustably biased to allow for adjustment of the workpiece guide tension on the workpiece during operations. The guide blade may be magnetically held to allow for ease of adjustment thereof.

The work blade and guide blade may be adjustably angled during grinding operations with respect to the regulating roller to provide for through-feed grinding of the workpieces at an adjustable feed rate and grinding time.

The invention, by the provision of pivotable operational elements which are adjustable during grinding operations, thus eliminates the need for laborious readjusting of the work and guide blades between the grinding of each different sized workpiece. By merely pivoting the operational element positions, resultant decreased set-up time and ready adjustability to different sized workpieces is attained. Pivoting of the blades further facilitates trueing of the work blade and regulating roller by the grinding wheel without removal of those operational elements from the carriage and will allow for simultaneous trueing of the work blade and regulating roller as necessary.

Other attendant advantages will be more readily appreciated as the same becomes better understood by reference to the following detailed description and considered in connection with the accompanying drawings in which like reference symbols designate the parts throughout the figures.

BRIEF DESCRIPTION OF THE DRAWINGS

FIG. 2 is a top plan view of the workpiece support apparatus hereof;

FIG. 3 is a perspective view of the apparatus shown in FIG. 2;

DESCRIPTION OF THE PREFERRED EMBODIMENT

As used herein positional terms such as vertical, horizontal, down, etc. are used in their ordinary sense as relating to a support apparatus whose regulating roller axis lies in a horizontal plane as the apparatus is supported with respect to an ordinary shop floor. It will be appreciated that other orientations of the support apparatus are possible while providing adequate functioning thereof.

Figure 1:
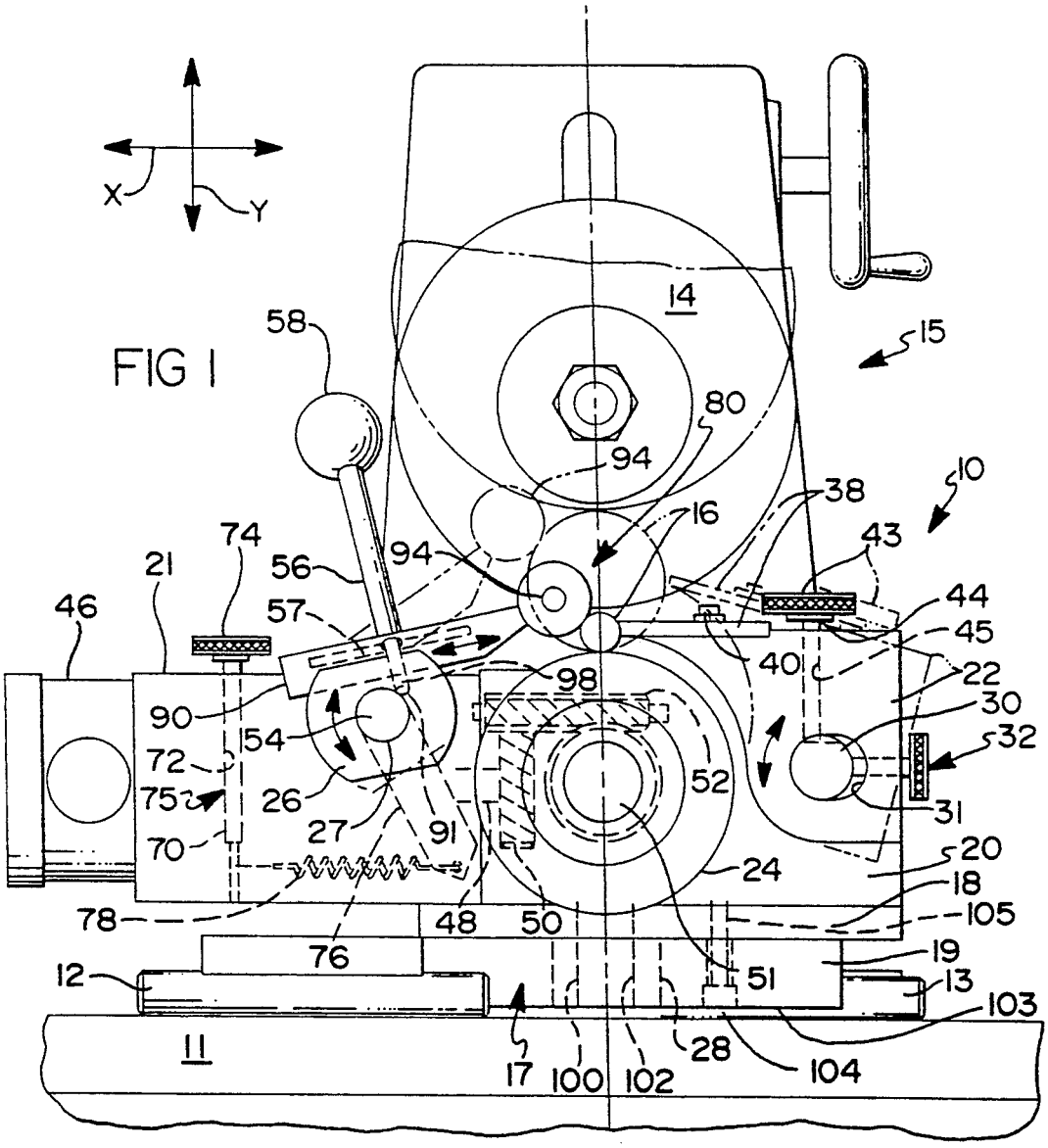
FIG. 1 is a front elevational view of a workpiece support apparatus mounted on a grinding machine according to the present invention.

As seen in FIG. 1, a workpiece support apparatus 10 according to the present invention is usually located on the upper side of sine bars 12, 13 and beneath a grinding wheel 14. The support apparatus 10 is generally designed to fit on a standard surface grinder 6"×12" magnetic chuck 11 with the sine bars 12, 13 resting on the chuck. The support apparatus 10 will thereby adapt a standard surface grinder 15 to perform a variety of centerless grinding and specialty grinding tasks. The standard surface grinder 15 has horizontal adjustments in both the x axis, perpendicular to a regulating roller 24 axis, or in the left and right directions as seen in FIG. 1; and the z axis, or parallel to the axis of the regulating roller 24 in FIG. 1. The standard surface grinder 15 will adjust a grinding wheel 14 in the y axis, or vertically perpendicular to the regulating roller 24 axis as seen in FIG. 1. It will be appreciated that x, y, z axis adjustment means could be readily provided with the support apparatus 10 if the same is to be used independently of a standard surface grinder.

The support apparatus 10 may be provided with means for tilting the apparatus off the horizontal, such as by being hinged to only one of the two sine bars 12, 13, as known in the art.

The support apparatus 10 generally comprises a base 17 mounted on sine bars 12, 13; and a carriage 20, mounted on the base 17, and having attached thereto, a pivotable work blade holder 22, a regulating roller 24, and pivotable workpiece guide holder 26.

As previously mentioned, the sine bars 12, 13 are mountable on a grinding machine mounting structure, thus, the support apparatus 10 is controllably slidable therewith by means known in the art.

The base 17 comprises the upper plate 18, attachable to the carriage 20, and a lower base plate 19 contacting the sine bars 12, 13. The base 17 further comprises a rotatable bearing assembly 28 located between the upper and lower base plates to allow the upper base plate 18, and thus, the carriage 20, to rotate through a 180° arc. This rotation allows for a great variety in selecting the grinding direction of the workpiece for specialized applications.

The rotatable bearing assembly 28 includes a base pin 100 rotatable within a bearing race, or bore, 102 located within the lower base plate 19. Base pin 100 is attached to the upper base plate 18. Upon rotation of the upper base plate 18 to the desired position, the base is locked in position by tightening a hold-down bolt 104 which extends upwardly from the underside 103 of the base 17 through a bore 105 in both base plates 18, 19.

The carriage 20 is mountable on the rotating upper base plate 18. The carriage 20 provides a means for mounting those support apparatus elements which operate on the workpiece 16 to perform the centerless grinding.

The work blade holder 22 is pivotally mounted to the carriage 20 by a pivot rod 30 passing through a slotted bore 31 formed through the holder 22, as shown in FIG. 1. The bore 31 is oversized along the x axis to allow room for the work blade holder pivot rod 30 to travel through an arc in the horizontal plane thereby angling the work blade holder 22 and its associated work blade 38 with respect to the z axis, i.e., the axis of the regulating roller 24 to vary the workpiece feed rate, as explained below.

As seen in FIG. 2, a fulcrum 84, located in the carriage 20 at a point outside the work blade holder 22, is connected to the pivot rod 30. A threaded control rod 86, connected to the pivot rod 30 through a bore 87 in the carriage 20, controls the arc of the pivot rod 30 through manipulation of the control rod attached handle 88. The pivot rod 30 is biased against the control rod 86 by a spring 85 located within the carriage 20. By changing the angle of the work blade holder 22 with respect to the axis of the regulating roller 24, the rotational forces applied to the workpiece 16 may be adjusted to thereby increase or decrease the feed rate of the workpiece through the support apparatus 10 during feed-through grinding operations.

As shown in phantom in FIG. 1, the work blade holder 22 also pivots through the y axis by rotation about the pivot rod 30. Adjustable securing members 32 have threaded rods 33 passing through the work blade holder 22 to contact the pivot rod 30. The securing members 32 are operated by their attached knobs 34 to provide a means for releasably securing the work blade holder 22 in the desired orientation within its y axis pivotal arc. A threaded shaft 44 is provided for fine pivoting of the work blade holder 22. A shaft handle 43 turns the shaft 44 within a partially threaded bore 45 located in the work blade holder 22. The shaft 44, which is off center of the pivot rod 30, thereby adjusts the height of the work blade 38 much in the manner of a screw jack.

The work blade holder 22 will thus be seen to be adjustable through a y axis pivotal arc to easily and automatically accommodate various sized diameters of workpieces to be ground, and is adjustable either during set up or during grinding operations. The off-center threaded shaft 44, handle 43, and the associated bore, together provide means for adjusting the height of the work blade holder and the work blade 38 which is held relative to the workpiece area, i.e., that area of the apparatus provided for placing the various sized workpieces therein.

Although not shown in the drawings, the work blade holder 22 could be provided with means for pivotally attaching the body thereof to a prexisting grinding apparatus in the manner of a retrofit.

As seen in FIGS. 1-5, the work blade 38 is releasably mounted to the work blade holder 22 at an upper surface thereof so as to engage the workpiece 16 at an angled, or radiused, work blade end 39 to provide a substantially channeled rest for the workpiece 16. Means for securing the work blade to its holder 22 include a threaded bolt 40, or bolts, passing through both the work blade and the holder. As best seen in FIG. 2, the work blade 38 has slots 42 formed therethrough to permit passage of the bolt 40 and allow for adjustment of the work blade 38 relative to the workpiece area.

Figure 4:
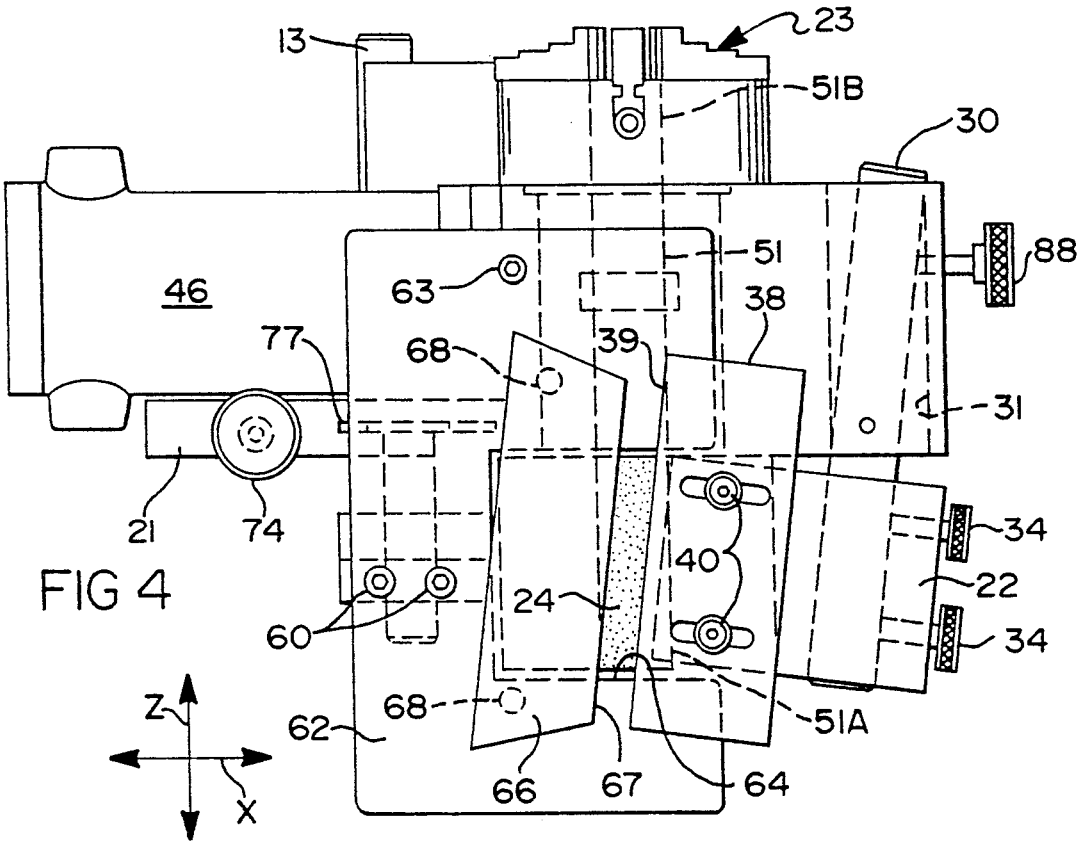
FIG. 4 is a top plan view showing the guide blade and work blade angled to adjust the feed rate of the workpiece when using the present invention in feed-through grinding operations.

Located laterally to the work blade holder 22 is the regulating roller 24, a driven wheel located beneath the workpiece area for drivingly contacting the workpiece 16 during grinding. The regulating roller 24 counterbalances the force of the grinding wheel 14 on the workpiece. The regulating roller 24 is driven by a motor 46 and drive train attached to the carriage 20 at motor mounts 47. As best seen in FIG. 1, the drive train includes a motor drive shaft 48, which drives a spur gear 50, which, in turn, drives a worm gear 52, which, in turn, drives a spindle 51 upon which is mounted the regulating roller 24 at a first area of the spindle 51*a*. As seen in FIG. 4, the spindle 51 extends through the carriage 20 and extends beyond opposite edges thereof at first and second spindle areas, 51*a* and 51*b* respectively. In the preferred embodiment, the gear train is utilized rather than a belt and pulley system to decrease overall size of the apparatus in order to permit the apparatus to fit on the standard surface grinder 6"×12" magnetic chuck. The gears are preferably made of plastic such as nylon in order to decrease vibration and noise during operation of the apparatus.

At the second spindle area 51*b* opposite the regulating roller 24, may be mounted additional operational elements such as an auxiliary regulating roller 25 (as seen in FIG. 3) for added control of long workpieces, or a separate workpiece chunk 23 (as seen in FIG. 4) to facilitate additional grinding of workpieces without centerless grinding. As shown in phantom in FIG. 3, when the additional operational element to be mounted on the spindle 51 is an auxiliary roller 25, an auxiliary work blade holder 37 should be mounted proximal thereto on the work blade holder pivot rod 30. To further decrease noise and vibration, dampening material 53, as seen in FIG. 3, may be placed between the motor mount 47 and carriage 20. It will be realized by the artisan that other drive means for the regulating roller may be suitably employed such as belts and pulleys, etc.

Referring, again, to FIG. 1, the workpiece guide holder 26 is pivotally mounted to the carriage 20 at a side of the regulating roller 24 opposite the work blade holder 22. The guide holder 26 is mounted over a pivot rod 54 by means of a cylindrical bore 27 formed in the workpiece guide holder 26. The pivot rod 54 is pivotally attached to an auxiliary carriage plate 21 which, in turn, is attached to the carriage 20. The pivot rod 54 defines at least a portion of the means for pivoting the workpiece guide holder 26 through the y axis between a workpiece 16 engaging position, as shown in solid lines in FIG. 1, and a non-engaging position as shown in phantom in FIG. 1.

Figure 5:
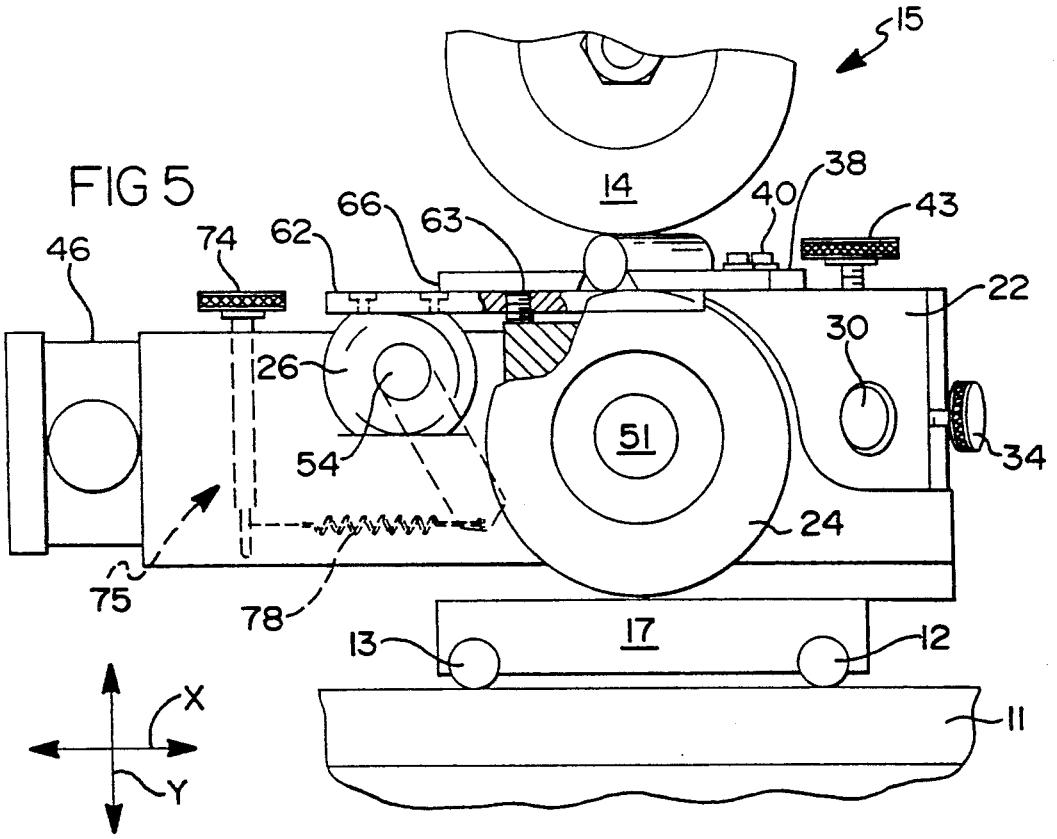
FIG. 5 is a front elevation according to FIG. 4 having a partial cut-away to illustrate details thereof.

The workpiece guide holder 26 carries thereon a workpiece guide element. The workpiece guide element may be either a pressure roller 80 (as seen in FIGS. 1-3) or a guide blade rest plate 62 (as seen in FIGS. 4 and 5) upon which is carried a guide blade 66 for abutting the workpiece 16 to maintain the position thereof. The guide element is attached to the guide holder 26 by threaded members 60 inserted through both the guide element and holder as further explained below. The guide element may be biased towards the workpiece area by a spring 78 a further explained below.

As seen in FIGS. 4 and 5, means for attaching a workpiece guide element to the guide holder 26 is provided by a bolt 60 through a guide element, such as a guide rest plate 62, and into a threaded bore 59 within the body of the workpiece guide holder 26.

The rest plate 62 extends horizontally towards the work blade holder 22 over the around the regulating roller 24. The rest plate 62 has a void 64 formed therein to allow the regulating roller 24 to pass therethrough so that the regulating roller 24 may contact a workpiece 16 resting partially on the rest plate 62 during grinding. As the regulating roller 24 wears down through use in grinding, the rest plate 62 will have to be correspondingly adjusted downward. Therefore, an adjustment pin 63, shown as a screw located within a bore and extending through the rest plate 62 and resting on carriage 20, is provided for adjustment of the level of the rest plate 62 and to counteract the downward bias placed upon the rest plate by the tension of the spring 78. By locating the adjustment pin 63 out of the path of the other operational elements the rest plate 62 may be adjusted during grinding operations.

The rest plate 62 may serve as a mounting platform for a guide blade 66 and as a rest platform for the workpiece 16 being ground and other workpieces being through-fed prior and subsequent to grinding.

The guide blade 66 is magnetically mounted to the surface of the guide rest plate 62 by an insulated magnet 68, or magnets, located within the base of the guide blade 66. The magnet 68 is insulated so as to have no magnetic effect on the guide blade 66. Magnetization of the guide blade 66 could produce undesirable retention of grinding chips thrown from the workpiece. The guide blade 66 places a forward restraining edge 67 against the workpiece 16 during grinding to act as a restraint against back movement of the workpiece 16 and to help provide a linear path therefor during through-feed. As the workpiece 16 will be urged towards the work blade 38 throughout grinding, it will be appreciated that the positioning requirements of the guide blade 66 are therefore not as stringent as for work blade 38, and therefore, simple manual adjustment of the magnetically held guide blade 66 will usually suffice. Different sized guide blades may be provided to accommodate different diameter workpieces.

As seen in FIGS. 1–3, as an alternative to the workpiece guide blade 66 and its associated rest plate 62, a pressure roller 80 may be utilized as a workpiece guide. The pressure roller 80 will be attached through a threaded end 98 of its handle 56 to the workpiece guide holder 26 having a slanting bore 57 at the upper surface thereof. The handle 56 is capped with an attached knob 58. The pressure roller 80 will be biased towards the workpiece 16 through the pivoting of the guide holder 26 as caused by the biasing means defined by the spring 78 and a lever 76 as further explained below.

The pressure roller 80 comprises a base 90 having a bore 91 therethrough to accept the threaded end 98 of the pressure roller handle 56 to thereby attach the pressure roller to the guide holder 26. Extending from the base 90 is an arm 92 to which is rotatably attached at one end a roller wheel 94, for contacting the workpiece 16. The handle 56 is provided for manual manipulation of the pressure roller 80.

As best seen in FIGS. 1 and 2, the workpiece guide holder 26 is spring biased by the lever 76 and the spring 78 to rotate towards the workpiece 16. The guide holder 26 has means 75, for adjusting the spring bias on the guide holder 26. The guide holder bias adjustment means 75 includes a rotating shaft 70 located within a bore 72 through the auxiliary carriage plate 21. The rotating shaft 70 is controlled by an attached knob 74. The rotating shaft 70 is connected to a lever 76 through the spring 78. The spring 78 and lever 76 are located in a void 77 within the auxiliary carriage plate 21 for protection from grinding debris, etc. The lever 76 is then attached to the pivot rod 54. Manipulation of the attached knob 74 will adjust the tension on the spring 78 and thereby the lever 76, to increase the force the pressure roller 80 may exert on the workpiece. Because the biasing of the pressure roller 80 towards the workpiece 16 takes place through the guide holder 26 and its adjustable tensioning means, the pressure roller tension may be adjusted at any time before, during, or after grinding operations. The tension adjustment of the workpiece guide holder 26 is of primary importance when the workpiece 16 is of a size to require the use of a pressure roller 80 as the workpiece guide element being attached thereto.

In use, the various heights and angles of the operational elements of the support apparatus 10 will be set to the required tolerances, and placed in contact with the workpiece 16; the grinding wheel 14 will be lowered to contact the workpiece 16; and grinding operations will be commenced. Should any of the operational elements need to be adjusted during grinding operations, it will be appreciated that such adjustments may be made to the above described elements during grinding operations to maintain consistent grinding results. When access to the workpiece 16 or workpiece area is desired the work blade holder 22 has merely to be pivoted to withdraw the work blade 38 from a workpiece engaging position. As the work blade 38 position is not changed with respect to its holder 22, the blade position will remain in tolerance and may be returned to work on variously sized diameters of work pieces merely by pivotally returning the blade from a workpiece non-engaging position to an engaging one, thus eliminating any extraneous set up time to readjust the blade.

Should the regulating roller 24 need to be trued in order to ensure close tolerance grinding of the workpiece 16; the workpiece guide element and work blade 38 may be easily withdrawn from the workpiece area to allow the grinding wheel 14 to be lowered to true the regulating roller 24. The work blade holder 22 is merely pivoted out of the way; while the pressure roller 80 may likewise be pivoted, or the magnetically held guide blade 66 may be manually withdrawn.

It is also possible to effect a trueing of the radiused work blade end 39 by pivoting the work blade holder up to expose the work blade to the grinding wheel 14. A simultaneous trueing of the work blade 38 and the regulating roller 24 may be accomplished by pivoting the work blade holder 22 up and shifting the carriage 20 laterally, if necessary, to allow the grinding wheel 14 to contact both the regulating roller 24 and the work blade 38 at once. A detent or pin (not shown) may be provided to ensure proper placement of the work blade holder 22 for presentation of the work blade 38 to the grinding wheel 14 for trueing.

Should compound angles be required to be ground into the workpiece 16, the apparatus may be tilted off the horizontal, and the support apparatus 10 turned oblique to the axis of the grinding wheel by rotation upon the base 17. End grinding of the workpiece 16 is particularly easy to accomplish by a 180° turn of the support apparatus with respect to the grinding wheel axis.

The use of the present invention decreases set up time between handling to workpieces and further facilitates trueing of the operational elements in an efficient manner. The preferred embodiment as illustrated is particularly useful for through-feed centerless grinding and is quickly and easily adapted for various other types of grindings such as punch grinding, end grinding, etc.

Having, thus, described the invention what is claimed is:

1. An apparatus for use in centerless grinding, the apparatus comprising:

(a) a carriage;

(b) a spindle which is rotatably mounted to the carriage for mounting a regulating roller thereon;

(c) a pivot rod;

(d) a work blade holder having a substantially flattened upper surface for attaching a work blade thereto, the work blade holder being pivotally attached to the carriage by the pivot rod and being pivotable thereon from a workpiece engaging position to a workpiece non-engaging position;

whereby the work blade holder may be angularly pivoted away from the spindle on the pivot rod to accommodate different sized workpieces without requiring substantial readjustment of the apparatus other than angular readjustment of the work blade holder.

2. A workpiece support apparatus for use in adapting a surface grinder to perform centerless grinding, comprising:

(a) a carriage;

(b) a spindle which is rotatably mounted to the carriage for mounting a regulating roller thereon;

(c) a pivot rod;

(d) a work blade holder having a substantially flattened upper surface for attaching a work blade thereto, the work blade holder being pivotally attached to the carriage by the pivot rod and being pivotable thereon from a workpiece engaging position to a workpiece non-engaging position;

whereby the work blade holder may be angularly pivoted away from the spindle on the pivot rod to accommodate different sized workpieces without requiring substantial readjustment of the apparatus other than angular readjustment of the work blade holder.

3. A workpiece support apparatus for use in adapting a surface grinder to perform centerless grinding, comprising:

(a) a carriage;

(b) a work blade holder which is pivotally attached to the carriage by a pivot rod and which is pivotable thereon from a workpiece engaging position to a workpiece non-engaging position; the work blade holder adapted to carry a substantially horizontal platelike work blade thereon which is capable of contacting a workpiece during grinding, the work blade holder including at least one fastener for securing the work blade thereto, (c) a base on which the carriage is mounted, the base being mountable on a pair of sine bars; and (d) wherein the work blade holder comprises a substantially vertical fulcrum which passes through the pivot rod, the work blade holder being pivotally movable about the fulcrum to control feed rate into the apparatus.

4. The apparatus of claim 3 further comprising:

a spindle rotatably mounted within the carriage, the spindle having a first area extending beyond the carriage for attaching a regulating roller thereto.

5. The apparatus of claim 4 further comprising:

a regulating roller attachable to the first area of the spindle.

6. The apparatus of claim 4 further comprising: means for rotating the spindle.

7. The apparatus of claim 6 wherein the means for rotating the spindle further comprises a driveshaft and gear-train assembly.

8. The apparatus of claim 3 further comprising a work blade attachable to the work blade holder.

9. The apparatus of claim 3 further comprising:

(a) a workpiece guide holder attached to the carriage, the workpiece guide holder having means for pivoting the guide holder between workpiece engaging and non-engaging positions; and, (b) means for attaching a workpiece guide to the workpiece guide holder.

10. The apparatus of claim 9 wherein the workpiece guide holder further comprises means for adjustably biasing the guide holder towards the workpiece engaging position.

11. The apparatus of claim 9 further comprising a workpiece guide attachable to the workpiece guide holder.

12. The apparatus of claim 11 wherein the workpiece guide is a pressure roller.

13. The apparatus of claim 11 wherein the workpiece guide further comprises a guide plate for extending substantially around a regulating roller.

14. The apparatus of claim 13 wherein the workpiece guide further comprises a workpiece guide blade attachable to the guide rest.

15. The apparatus of claim 14 wherein the workpiece guide blade is magnetically attachable to the guide rest.

16. The apparatus of claim 13 wherein the guide rest further comprises means for adjusting the guide rest relative to the height of the regulating roller.

17. The apparatus of claim 16 wherein a means for adjusting the guide-rest further comprises an adjustment pin extending through the rest plate, the adjustment pin resting on the carriage, and located so as to be adjustable during the grinding operation.

18. A workpiece support apparatus for use in centerless grinding, comprising:

(a) a base which is mountable on a grinding machine, the base including means for allowing rotation of a carriage mounted on the base;

(b) a carriage which is mounted on the base;

(c) a work blade holder which is pivotally attached to the carriage and which is pivotally movable on a first pivot axis from a workpiece engaging position to a workpiece non-engaging position, the work blade holder including:

(1) means for securing a work blade thereto; and (2) means for allowing pivotal movement of the work blade holder on a second pivot axis which is non-parallel to the first pivot axis of the work blade holder, the means for allowing pivotal movement comprising a pivot rod and a substantially vertical fulcrum on which the pivot rod is pivotally mounted;

(d) a regulating roller for rotatingly driving a workpiece; and (e) a workpiece guide holder operatively attached to the carriage and including:

(1) means for attaching a workpiece guide element thereto; and (2) means for allowing pivotal movement of the workpiece guide element between workpiece engaging and non-engaging positions.

19. The apparatus of claim 18 further comprising a grinding wheel adjustable vertically with respect to carriage.

20. The apparatus of claim 18 further comprising a means for preventing rotation of the base, the prevention means being operatively engageable from a surface of the apparatus other than an undersurface of the base plate.

21. An apparatus for use in centerless grinding, comprising:

(a) a carriage;

(b) a spindle which is rotatably mounted to the carriage for mounting a regulating roller thereon;

(c) a pivot rod; and (d) a work blade holder which is pivotally attached to the carriage by the pivot rod and which is angularly pivotable thereon from a workpiece engaging position proximate the spindle to a workpiece non-engaging position in which an upper surface of the work blade holder is pivotally moved away from the spindle.

22. The apparatus of claim 21, further comprising a base on which the carriage is mounted, the base including means for allowing rotatable movement of the carriage thereon.

* * * * *